US009955251B1

(12) United States Patent
Zu et al.

(10) Patent No.: US 9,955,251 B1
(45) Date of Patent: Apr. 24, 2018

(54) SOUNDER MODULE

(71) Applicant: GOERTEK INC., WeiFang, Shandong (CN)

(72) Inventors: Fenglei Zu, WeiFang (CN); Xiaodong Guo, WeiFang (CN)

(73) Assignee: GOERTEK INC., WeiFeng (CN)

( * ) Notice: Subject to any disclaimer, the term of this patent is extended or adjusted under 35 U.S.C. 154(b) by 0 days.

(21) Appl. No.: 15/562,857

(22) PCT Filed: Nov. 18, 2015

(86) PCT No.: PCT/CN2015/094897
§ 371 (c)(1),
(2) Date: Sep. 28, 2017

(87) PCT Pub. No.: WO2016/155327
PCT Pub. Date: Oct. 6, 2016

(30) Foreign Application Priority Data

Mar. 31, 2015 (CN) ..... 2015 1 0149655

(51) Int. Cl.
*H04R 1/02* (2006.01)
*H04R 1/28* (2006.01)
(Continued)

(52) U.S. Cl.
CPC ..... *H04R 1/2888* (2013.01); *H04R 1/023* (2013.01); *H04R 1/025* (2013.01); *H04R 7/127* (2013.01); *H04R 9/025* (2013.01); *H04R 31/00* (2013.01)

(58) Field of Classification Search
USPC ..... 381/152, 162, 164, 178, 191, 423, 424, 381/426, 332, 335, 430
See application file for complete search history.

(56) References Cited

U.S. PATENT DOCUMENTS 6,229,903 B1 * 5/2001 Kobayashi ..... H04R 9/00 367/173
7,801,324 B2 9/2010 Kimura et al.
(Continued)

FOREIGN PATENT DOCUMENTS

CN 1222049 A 7/1999
CN 1420673 A 5/2003
(Continued)

OTHER PUBLICATIONS

International Search Report, dated Feb. 6, 2016, State Intellectual Property Office of the P. R. China.

*Primary Examiner* — Yosef K Laekemariam
(74) *Attorney, Agent, or Firm* — Holzer Patel Drennan

(57) ABSTRACT

Disclosed is a sounder module, which comprises a housing for accommodating a vibration system and a magnetic circuit system. The housing is provided with a sound hole which is formed to deviate from the center position of the vibration system and is higher than the surface of the housing. The vibration system comprises a vibrating diaphragm. A dome is provided at one side of the vibrating diaphragm closer to the sound hole. A pressure regulating part is arranged on the dome. The pressure regulating part is higher than other positions of the dome and projects towards the sound hole. The sounder module in the present invention is capable of balancing asymmetrical sound field distribution of the front acoustic cavity, and locally increasing the sound pressure distribution on the surface of the vibrating diaphragm to balance it with other parts, effectively decreasing system polarization, and reducing harmonic distortion.

11 Claims, 3 Drawing Sheets

(51) Int. Cl.

| | |
|---|---|
| ***H04R 9/02*** | (2006.01) |
| ***H04R 31/00*** | (2006.01) |
| ***H04R 7/12*** | (2006.01) |

(56) References Cited

U.S. PATENT DOCUMENTS

| | | | | |
|---|---|---|---|---|
| 8,290,200 | B2 * | 10/2012 | Chen | H04R 7/122 381/420 |
| 2007/0053547 | A1 * | 3/2007 | Ando | H04R 9/06 381/430 |

FOREIGN PATENT DOCUMENTS

| | | | |
|---|---|---|---|
| CN | 201234336 | Y | 5/2009 |
| CN | 201238374 | Y | 5/2009 |
| CN | 101909232 | A | 12/2010 |
| CN | 202565429 | U | 11/2012 |
| CN | 203368734 | U | 12/2013 |
| CN | 204498360 | U | 7/2015 |
| CN | 104902401 | A | 9/2015 |
| JP | 2006333064 | A | 12/2006 |
| JP | 2012109691 | A | 6/2012 |

* cited by examiner

SOUNDER MODULE

TECHNICAL FIELD

The present invention relates to the technical field of electro-acoustic products, specifically, to a sounder module.

BACKGROUND

The sounder module is an important acoustical component of the portable electronic device, is used for transforming electrical signal to acoustical signal, and is an energy converter. The existing sounder module typically comprises a housing in which a vibration system and a magnetic circuit system are accommodated. The housing is provided with a sound hole at the position opposite to the vibration system. The sound hole is formed to be opposite to the centre position of the vibration system, and the end part of the sound hole is flush with the outer surface of the housing. However, in some sounder modules, in order to meet the requirement on structure design of the integrated system, a protruded upper sound hole is typically provided, that is, the channel of the sounding hole is relatively longer, and its end part is higher than the outer surface of the housing. At the same time, in order to meet the requirement on system assembly, the sound hole cannot be provided at the center position of the vibration system. Such an asymmetric rising opening of the sound hole will cause the asymmetrical sound field distribution of a front acoustic cavity of the sounder module. The sound pressure is released largely at the sound hole, and thus the sound field energy is more concentrated at the sound hole. The region with relatively concentrated sound field energy will cause larger reaction force to the vibrating system, resulting in the asymmetrical sound pressure distribution on the surface of the vibrating diaphragm, as shown in FIG. 5. The asymmetric arrangement of the sound hole will lead to the asymmetrical sound loading force distribution on the surface of the vibrating diaphragm, which will directly lead to aggravated polarization of the vibration system, and increased harmonic distortion.

SUMMARY

In view of the above defects, the technical problem sought to be solved by the present invention is to provide a sounder module, which is capable of balancing asymmetrical sound field distribution in the front acoustic cavity, and locally increasing the sound pressure distribution on the surface of the vibrating diaphragm to balance it with other parts, decreasing system polarization, and reducing harmonic distortion.

In order to solve the above technical problem, the technical solution of the present invention is:

A sounder module, comprising a housing, wherein a vibration system and a magnetic circuit system are accommodated in the housing, and the housing is provided with a sound hole at a position corresponding to the vibration system; the sound hole is arranged to deviate from the centre position of the vibration system, and the sound hole is a rising opening with an end part higher than the surface of the housing; the vibration system comprises a vibrating diaphragm, a dome is provided at the centre part of a side of the vibrating diaphragm adjacent to the sound hole, the dome is provided with a pressure regulating part at a position corresponding to an orthographic projection area of the sound hole, and the pressure regulating part is higher than other portions of the dome and protrudes towards the direction of the sound hole.

Wherein, the housing comprises an upper housing and a lower housing which are combined together, and the sound hole is provided on the upper housing.

Wherein, the pressure regulating part has a curved structure with a higher center and a lower periphery.

Wherein, the pressure regulating part has a planar structure, and the periphery of the pressure regulating part is connected to the other portions of the dome through a sloping surface.

Wherein, the pressure regulating part has a structure having a wavy surface.

Wherein, the sound hole is provided at a position adjacent to an edge of one side of the dome.

Wherein, the end part of the sound hole is covered with a dust screen.

Wherein, the shape and size of the pressure regulating part are adapted to that of the orthographic projection area of the sound hole.

Wherein, the pressure regulating part on the dome is molded through a hot-pressing process.

According to the technical solution of the present invention, the advantageous effects of the present invention are described below.

As the sounder module of the present invention comprises a housing, which provided with a sound hole at a position opposite to the vibration system, and the sound hole is arranged in such a way so as to deviate from the centre position of the vibration system and is a rising opening with an end part higher than the surface of the housing. The centre part of a side of the vibrating diaphragm of the vibration system adjacent to the sound hole is provided with a dome. The dome is provided with a pressure regulating part at a position corresponding to an orthographic projection area of the sound hole. The pressure regulating part is higher than the other portions of the dome and protrudes towards the direction of the sound hole. The pressure regulating part protruded in the direction of the sound hole is provided at the position of the dome corresponding to the orthographic projection area of the sound hole. The ratio of sound volume of the sound hole area to the non-sound hole area of the front acoustic cavity can be re-adjusted by the pressure regulating part. When the vibration system begins to radiate sound pressure, the re-adjusted sound volume can balance the asymmetry of the sound field distribution in the front acoustic cavity, and locally increase the sound pressure distribution on the surface of the vibrating diaphragm, so that the sound pressure on a part of the surface of the vibrating diaphragm in the sound hole area is balanced with the sound pressure on other parts of the surface of the vibrating diaphragm. Thus, it is possible to effectively reduce the magnitude of polarization of the system and improve the harmonic distortion of the sounder module.

In conclusion, by means of the sounder module in the present invention, the technical problem in the prior art of asymmetrical sound field distribution of a front acoustic cavity in a sounder module is solved. The sounder module in the present invention is capable of balancing asymmetrical sound field distribution of the front acoustic cavity, and locally increasing the sound pressure distribution on the surface of the vibrating diaphragm to balance it with other parts, effectively decreasing system polarization, and reducing harmonic distortion.

Figure 1:
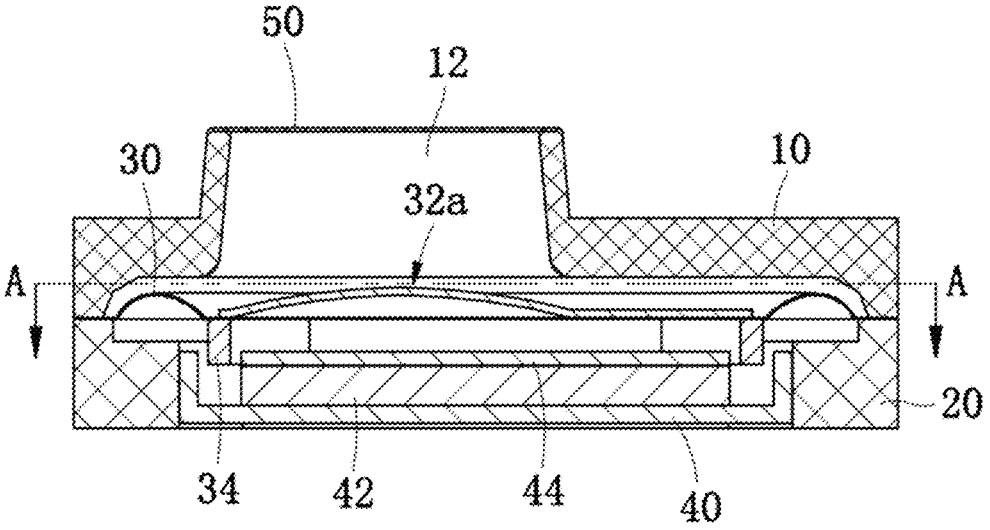
FIG. 1 is a schematic structural view of the embodiment 1 of the sounder module according to the present invention.

In the drawings: 10*a*, upper housing; 12, sound hole; 20, lower housing; 30, vibrating diaphragm; 32*a*, dome; 32*b*, dome; 320*a*, pressure regulating part; 320*b*, pressure regulating part; 322, central portion; 324, connecting portion; 34, voice coil; 40, yoke; 42, magnet; 44, washer; 50, dust screen.

DETAILED DESCRIPTION

The present invention is described below in details in connection with the accompanying drawings and embodiments.

The "upward" orientation related in this specification refers to the direction of the vibration system, and the "downward" orientation refers to the direction of the magnetic circuit system. The term "inside" related in this specification refers to a side inside the interior cavity of the module, and the term "outside" refers to a side outside the interior cavity of the module.

Embodiment 1

As shown in FIG. 1, a sounder module comprises a housing which is constituted by an upper housing 10 and a lower housing 20 combined together. The space defined by the upper housing 10 and the lower housing 20 accommodates a vibration system and a magnetic circuit system. The vibration system comprises a vibrating diaphragm 30, an edge portion of the vibrating diaphragm 30 is fixed between the upper housing 10 and the lower housing 20, a dome 32*a* is fixed on the centre part of one side of the vibrating diaphragm 30 which side is adjacent to the upper housing 10, and a voice coil 34 is fixed on the other side of the vibrating diaphragm 30. The magnetic circuit system comprises a yoke 40 fixed inside the lower housing 20. A magnet 42 and a washer 44 are successively fixed at the centre position of the inner side of the yoke 40. A magnetic gap is arranged between the sidewalls of the magnet 42 along with the washer 44 and the sidewall of the yoke 40, and the end portion of the voice coil 34 is located in the magnetic gap. The voice coil 34 is reciprocated up and down in the magnetic gap according to the magnitude and polarity of the electric signal of the sound wave passing through the windings of the voice coil 34, and the vibrating diaphragm 30 and the dome 32*a* vibrate as the voice coil 34 vibrates up and down. Thus, air is forced to vibrate to generate sound, thereby completing the energy conversion between electric energy and acoustic energy.

Figure 2:
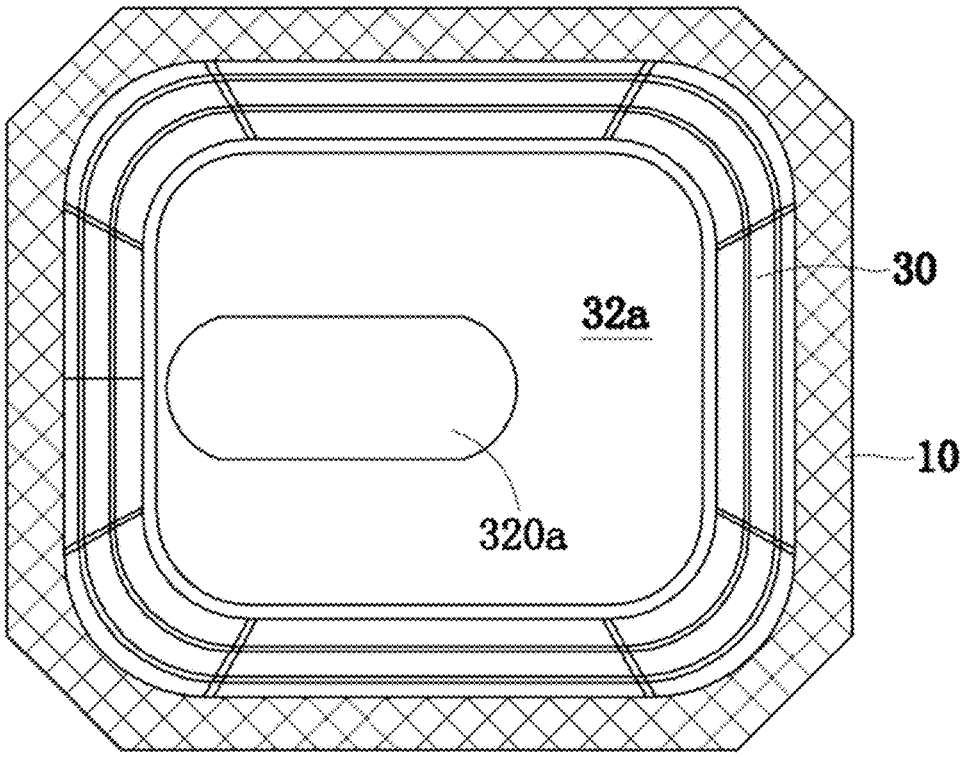
FIG. 2 is a cross-sectional view taken along line A-A in FIG. 1.

As shown in FIG. 1 and FIG. 2, a sound hole 12 is provided at a position on the upper housing 10 opposite to the vibration system. The sound hole 12 is provided adjacent to one side edge of the dome 32*a* and deviates from the center of the vibration system, and the sound hole 12 is a rising opening with an end part higher than the surface of the upper housing 10. A pressure regulating part 320*a* is arranged at a position on the dome 32*a* corresponding to the orthographic projection area of the sound hole 12. The pressure regulating part 320*a* is higher than the other portions of the dome 32*a* and protrudes towards the direction of the sound hole 12.

As shown in FIG. 1 and FIG. 2, the pressure regulating part 320*a* has a curved structure with a lower periphery and a higher center, and the size and height of the pressure regulating part 320*a* are required to be set in accordance with the amplitude of the vibration system and the acoustic performance requirements of the module, that is, the size and height is set to balance the sound pressure, reduce the system polarization, and not contact with the inner wall of the upper housing 10, which can be determined by simulation experiments. In the present embodiment, it is preferable that the shape and size of the pressure regulating part 320*a* are adapted to the orthographic projection area of the sound hole 12. In practice, the shape and size of the pressure regulating part can be adjusted by the result of the simulation experiment, that is, its shape may be other shapes different from the shape of the orthographic projection area of the sound hole 12, and its size may be smaller or larger than the size of the orthographic projection area of the sound hole 12.

As shown in FIGS. 1 and 2, the pressure regulating part 320*a* is integrally formed with the other portions of the dome 32*a*. The pressure regulating part 320*a* may be formed by an infrared hot press molding process or air pressure molding process. In the present embodiment, the infrared hot press molding process is preferred, because the mold for the infrared hot press molding process is simple, the molding is faster and the production efficiency is higher.

As shown in FIG. 1, the end part of the sound hole 12 is covered with a dust screen 50. The dust screen 50 can block external dust and debris from entering the inner cavity of the sounder module from the sound hole 12, thereby prolonging the service life of the sounder module.

As shown in FIG. 1, the lower housing 20 has an annular structure with both upper and lower ends open, and the yoke 40 is mounted at the opening of the lower end of the lower housing 20. After the module assembly is completed, the outer surface of the yoke 40 is flush with the lower end surface of the lower housing 20. With such a configuration, the thickness of the module may be reduced effectively so as to meet the requirement on thin type of portable electronic equipments.

Embodiment 2

Figure 3:
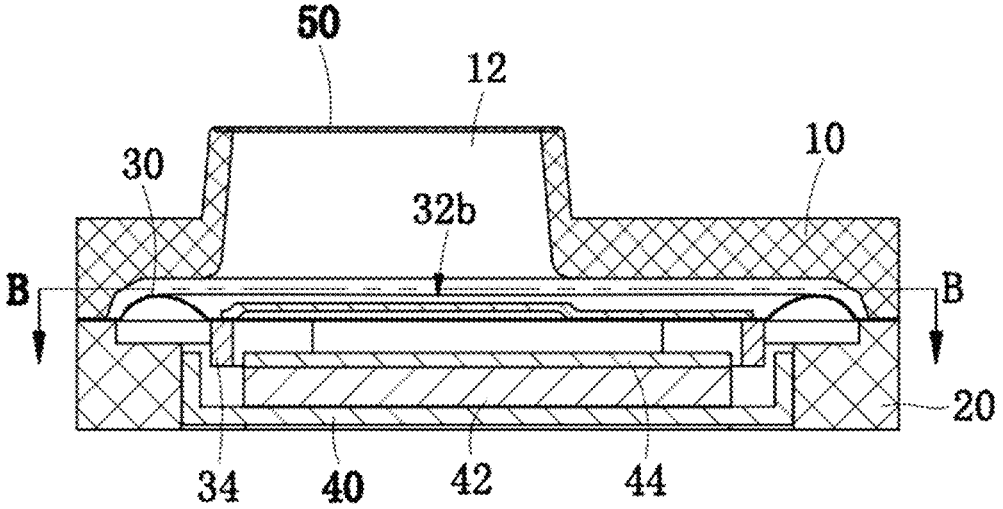
FIG. 3 is a schematic structural view of the embodiment 2 of the sounder module according to the present invention.
Figure 4:
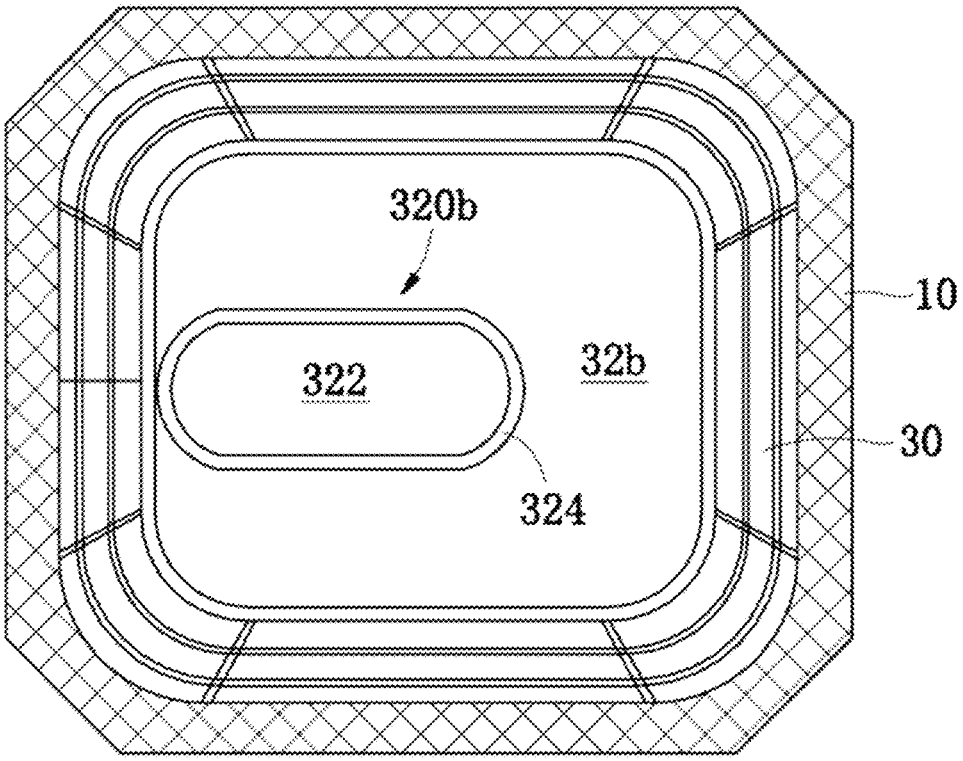
FIG. 4 is a cross-sectional view taken along line B-B in FIG. 3.
Figure 5:
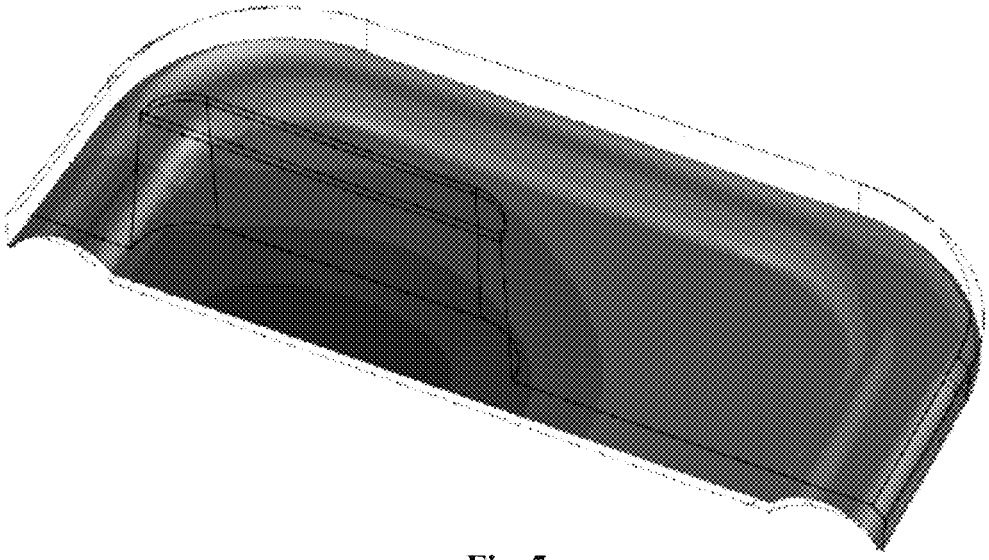
FIG. 5 is a sound pressure profile on the surface of the vibrating diaphragm with an offset sound hole.

The present embodiment is substantially the same as the first embodiment, except that:

as jointly shown in FIG. 3 and FIG. 4, a pressure regulating part 320*b* is arranged at a position on the dome 32*b* corresponding to the orthographic projection area of the sound hole 12; the pressure regulating part 320*b* comprises a central portion 322 having a planar structure, and the periphery of the central portion 322 is integrally connected to the other portions of the dome 32*b* through the connecting portion 324; and the connecting portion 324 has an annular sloping structure having a substantially tapered shape.

The structure of the pressure regulating part is not limited to the structures described in the above two embodiments, and the pressure regulating part may have a wavy structure in which a recess is provided in the middle, or other structures, as long as it can balance the sound pressure in the front acoustic cavity.

According to the present invention, by arranging the dome into an asymmetric structure, that is, the pressure regulating part protruded in the direction of the sound hole is provided at the position of the dome corresponding to the orthographic projection area of the sound hole. The ratio of sound volume of the sound hole area to the non-sound hole area of the front acoustic cavity can be re-adjusted by the pressure regulating part. When the vibration system begins to radiate sound pressure, the re-adjusted sound volume can balance the asymmetry of the sound field distribution in the front acoustic cavity, and locally increase the sound pressure distribution on the surface of the vibrating diaphragm, so that the sound pressure on a part of the surface of the vibrating diaphragm in the sound hole area is balanced with the sound pressure on other parts of the surface of the vibrating diaphragm. Thus, it is possible to effectively reduce the magnitude of polarization of the system and improve the harmonic distortion characteristics of the sounder module.

In the present specification, the technical solution of the present invention, in which a protruded pressure regulating part is provided at a position on the dome corresponding to the orthographic projection area of the sound hole, is illustrated by taking the above sounder modules as examples. The structure of the sounder module in practical application is not limited to the above structures. The technical solution of the present invention can be applied to any one of the modules in which the sound hole is an offset rising opening. Thus, the products, in which a protruded pressure regulating part is provided at the position of the dome corresponding to the orthographic projection area of the sound hole for reducing the polarization of the system and reducing the harmonic distortion, are within the protection scope of the present invention, regardless of whether or not the structure of the sounder module is the same as that in the above embodiments.

The present invention is not limited to the above specific embodiments, and various variations made by those skilled in the art according to the above conceptions without creative labor fall into the protection scope of the present invention.

What is claimed is:

1. A sounder module, comprising a housing, wherein a vibration system and a magnetic circuit system are accommodated in the housing, and the housing is provided with a sound hole at a position corresponding to the vibration system; the sound hole is arranged to deviate from a centre position of the vibration system, and the sound hole is a rising opening with an end part higher than a surface of the housing; the vibration system comprises a vibrating diaphragm, and a dome is provided at a centre part of a side of the vibrating diaphragm adjacent to the sound hole, wherein the dome is provided with a pressure regulating part at a position corresponding to an orthographic projection area of the sound hole, and the pressure regulating part is higher than other portions of the dome and protrudes towards a direction of the sound hole.

2. The sounder module according to claim 1, wherein the housing comprises an upper housing and a lower housing which are combined together, and the sound hole is provided on the upper housing.

3. The sounder module according to claim 2, wherein the pressure regulating part has a curved structure with a higher center and a lower periphery.

4. The sounder module according to claim 2, wherein the pressure regulating part has a planar structure, and a periphery of the pressure regulating part is connected to the other portions of the dome through a sloping surface.

5. The sounder module according to claim 2, wherein the pressure regulating part has a structure having a wavy surface.

6. The sounder module according to claim 3, wherein the sound hole is provided at a position adjacent to an edge of one side of the dome.

7. The sounder module according to claim 6, wherein the end part of the sound hole is covered with a dust screen.

8. The sounder module according to claim 7, wherein a shape and a size of the pressure regulating part are adapted to that of the orthographic projection area of the sound hole.

9. The sounder module according to claim 1, wherein the pressure regulating part on the dome is molded through a hot-pressing process.

10. The sounder module according to claim 4, wherein the sound hole is provided at a position adjacent to an edge of one side of the dome.

11. The sounder module according to claim 5, wherein the sound hole is provided at a position adjacent to an edge of one side of the dome.

* * * * *